United States Patent [19]

Miller

[11] Patent Number: 4,902,534

[45] Date of Patent: Feb. 20, 1990

[54] METHOD FOR PRODUCING PLIABLE WALLCOVERING TO REPLICATE AGED, CRACKED PLASTER WALL FINISH

[76] Inventor: Ralph E. Miller, 216 S. 5th Ave., Phoeniz, Ariz. 85003

[21] Appl. No.: 261,494

[22] Filed: Oct. 24, 1988

[51] Int. Cl.[4] ..... B05D 5/00

[52] U.S. Cl. ..... 427/257; 156/71; 156/196; 427/264; 427/334; 427/403; 428/155; 428/269; 428/703; 428/904.4

[58] Field of Search ..... 156/42, 45, 71, 229, 156/196; 427/176, 257, 334, 403, 271, 264, 270; 428/155, 904.4, 703, 269, 248, 253; 160/327

[56] References Cited

U.S. PATENT DOCUMENTS

| | | | |
|---|---|---|---|
| 259,493 | 6/1882 | Church | 428/703 X |
| 1,722,968 | 7/1929 | Boughton | 427/257 X |
| 3,400,036 | 9/1968 | Hemrick et al. | 428/155 X |
| 3,776,337 | 12/1973 | Mand et al. | 428/904.4 X |
| 4,053,669 | 10/1977 | Kapasi et al. | 427/264 X |
| 4,202,716 | 5/1980 | Roman | 427/264 X |

FOREIGN PATENT DOCUMENTS

| | | | |
|---|---|---|---|
| 2534638 | 2/1976 | Fed. Rep. of Germany | 428/155 |
| 0073216 | 6/1978 | Japan | 428/703 |

*Primary Examiner*—Robert A. Dawson
*Assistant Examiner*—David W. Herb
*Attorney, Agent, or Firm*—Tod R. Nissle

[57] ABSTRACT

A method and apparatus for making a pliable wallcovering. The wallcovering replicates the appearance of aged, cracked plaster wall finishes, can be readily hung over existing walls, and is durable. In the method of making the wallcovering a putty-like joint compound mixture is applied to a pliable stretchable woven sheet. The sheet is comprised of strands forming interstitial openings extending through the sheet. The joint compound mixture is forced through the interstitial openings and is allowed to dry. The dried joint compound mixture is cracked in a manner which renders the wallcovering pliable.

13 Claims, 1 Drawing Sheet

METHOD FOR PRODUCING PLIABLE WALLCOVERING TO REPLICATE AGED, CRACKED PLASTER WALL FINISH

This invention relates to wall coverings.

More particularly, the invention relates to a method and apparatus for producing a wall covering which replicates the appearance of aged, cracked plaster wall finishes, which can be readily hung over an existing wall, which is durable and wear resistant in transport, and which, while replicating the cracks and brittleness of aged wall plaster, is pliable.

In a further respect, the invention relates to a method for producing wall coverings which reinstates the use of woven fabric backings which have long been held in disfavor for wall coverings and which enable a plaster finish having an aged appearance to be produced on the wall in a home or other building structure without the expense, time, and complications associated with the conventional process for plastering a wall.

As is noted in U.S. Pat. No. 4,460,634 to Stevens et al., in the 1920's wallcover was introduced which had a backing of woven fabric. Woven wallcover backings fell into disfavor because of their expense and because of physical disadvantages relating to permeability and adhesion. As a result, wallcovering manufacturers began utilizing paper and then nonwoven material as backing for their wallcover products. In a manner similar to the demise of woven wallcover backings, the plastering of walls gradually fell into disfavor because of the time, cost, and complications associated with the plastering process. Plastering is messy. Plaster tends to crack or peel, especially during humid weather or during the occurrence of either earth tremors or the expansion and contraction of the wall carrying the plaster. While the conventional method of wall plastering and the upkeep associated with plaster have fallen into disfavor, the unique appearance of a plastered wall has continued to be admired by many. Further, the cracked, aged look of old plaster walls is often desired by homeowners.

Accordingly, it would be highly desirable to provide a method which would provide a wall with the appearance of a plaster finish and which would at the same time minimize the upkeep, the tendency to crack, and the installation time associated with conventional plastering processes.

Therefore, it is a principal object of the invention to provide an improved method and apparatus for producing a plaster finish on a wall in a home or other building structure.

Another object of the invention is to provide a method for plastering a wall which enables a plaster finish to be quickly produced on a wall while foregoing the time, cost, and complications associated with conventional plastering procedures.

A further object of the invention is to produce a plaster finish for a wall which minimizes the cracking and peeling tendencies of conventional plaster walls, especially during humid weather, during expansion and contraction of the wall structure, and during earth tremors.

Still another object of the instant invention is to provide a method for producing a pliable plaster wallcovering.

Yet a further object of the invention is to provide a method for producing a plaster wall finish which, while replicating the cracked appearance of aged wall plaster, minimizes the likelihood that the plaster will separate from the wall.

These and other, further and more specific objects and advantages of the invention will be apparent to those skilled in the art from the following detailed description thereof, taken in conjunction with the drawings, in which:

DESCRIPTION OF THE PREFERRED EMBODIMENTS

Figure 1:
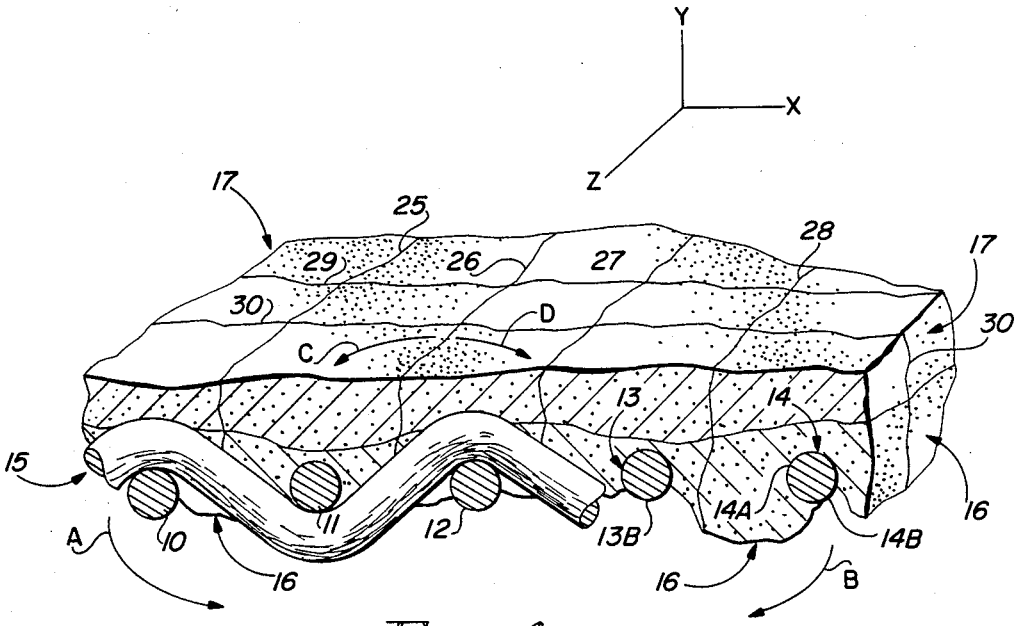
FIG. 1 is a perspective section view of the wallcovering produced in accordance with the principles of the invention.

Briefly, in accordance with my invention, I provide an improved method for making a pliable wallcovering. The wallcovering replicates the appearance of aged, cracked plaster wall finishes, can be readily hung over an existing wall, and is durable and wear resistant. The method comprises the steps of weaving water absorbent strands of material in a coarse weave to form a pliable stretchable fabric sheet with interstitial openings extending between the strands from the top to the bottom of the sheet, the strands being comprised of a plurality of threads; mixing joint compound, water, and water soluble glue to form a spreadable joint compound mixture; spreading a first layer of the joint compound mixture over the top of the woven sheet to force the joint compound into and through at least certain of the interstitial openings to the back of the sheet, the strands absorbing water and water soluble glue from the joint compound mixture; spreading a second layer of the joint compound mixture over the first layer to cover the top of the woven sheet; drying the first and second layers of joint compound and the strands of material; stressing the dried layers of joint compound to form a plurality of cracks each extending through the layer to the pliable woven sheet, each of the cracks acting as a hinged member which can be pliably folded about said sheet; and, applying a liquid oil base coloring agent coating to said cracked dried layers to penetrate and seal the surfaces of each of said cracks to inhibit the sealing together of the crack surfaces when water is applied to said wall covering. The cracks formed in the wallcovering can include first and second sets of substantially parallel spaced apart cracks with the first set of cracks being at an angle with respect to and intersecting the second set of cracks. The improved method can include the step of applying a second coating of a coloring agent to the dried second layer to highlight the surface contour of the second layer.

In another embodiment of my invention, I provide an improved method for making a wall covering. The wall covering replicates the appearance of plaster wall finishes, can be readily hung over an existing wall, and is durable and wear resistant. The improved method includes the steps of weaving water absorbent strands of material into a coarse weave to form a pliable stretchable fabric sheet with interstitial openings extending between the strands from the top to the bottom of the sheet, the strands being comprised of a plurality of threads of the material; mixing joint compound, water, water soluble glue, cellulose paste, and saw dust to form a spreadable joint compound mixture; spreading a first layer of the joint compound mixture over the top of the woven sheet to force the joint compound into and through at least certain of the interstitial openings to the back of the sheet, the strands absorbing water and water soluble glue from the joint compound mixture; spreading a second layer of the joint compound mixture over the first layer to cover the top of the woven sheet; drying the first and second layers of joint compound and the strands of material; and, applying a liquid oil base coloring agent coating to the dried layers to penetrate and seal the surface of the second layer to inhibit the absorption of water applied to the dried layers. The dried layers of joint compound mixture can be stressed to form at least one crack extending through the layers to the pliable woven sheet, the crack acting as a hinge member which can be folded about said pliable woven sheet. The woven sheet can be attached to a wall in a building structure. The sheet can be attached to the wall at selected spaced apart points on the wall such that when the wall expands the fabric sheet stretches intermediate the attachment points.

Figure 3:
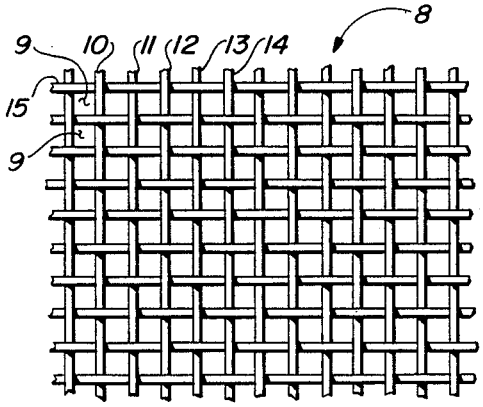
FIG. 3 is a top view of the fabric weave utilized in the wallcovering of FIG. 1; and, FIG. 4 is a perspective view illustrating the pliable nature of the wallcovering of FIG. 1.

Turning now to the drawings, which depict the presently preferred embodiments of the invention for the purpose of illustrating the practice thereof and not by way of limitation of the scope of the invention, and in which corresponding reference characters represent like elements throughout the several views, FIG. 1 illustrates wallcovering constructed in accordance with the invention. In FIG. 1 layers 16 and 17 are applied to a woven sheet of water absorbent strands 10–15 of material. The weave of strands 10–15 is illustrated in FIG. 3 and includes interstitial openings 9 which extend from the top of the sheet 8 of woven material intermediate the strands and to the bottom of the sheet 8. Each strand 10–15 is comprised of a plurality of threads. Strands 10–15 are pliable and water absorbent and are preferably comprised of threads from a natural source like hemp or jute, although synthetic water absorbent strands can be utilized. One advantage or natural fibers like hemp and jute is that glues often adhere to them better than synthetic fibers. Synthetic fibers sometimes have a smooth glassy surface to which glues do not readily adhere. In order to form layers 16 and 17 in FIG. 1, a joint compound mixture is prepared and includes water and joint compound of the type utilized to fill the seams intermediate four feet by eight feet plasterboard panels which are nailed to the two by four framing in the wall of a house. Such conventional joint compound typically comes in a white powder form and is mixed with water to form a slurry having a spreadable, putty like consistency. The joint compound mixture utilized in the invention also includes water soluble glue and has a spreadable, putty like consistency, but can include more water to insure that the joint compound mixture can, when applied to the top of a woven sheet 8 with a putty knife or other tool, be forced through the interstitices 9 to the bottom of the sheet 8. Accordingly, in FIG. 1, layer 16 is first applied to sheet 8 such that the joint compound mixture is forced through at least some, but preferably most, of the interstitial openings 9 intermediate strands of material in sheet 8. For example, in FIG. 1 joint compound mixture in the layer 16 is readily seen as extending downwardly between strands 13 and 14. The joint compound mixture extends from the top 14A of strand 14, intermediate strands 13 and 14, and extends to, past, and around the bottom 14B of strand 14. Similarly, the joint compound mixture extends from the top of strand 13, intermediate strands 13 and 14, and downwardly past the bottom 13B of strand 13. The joint compound mixture also actually contacts and extends partially across the bottom 14B of strand 14. When layer 16 is applied to woven sheet 8, forcing the joint compound mixture entirely through interstitial openings 9 is important because it interlocks the joint compound mixture with the strands in the sheet 8 and also facilitates absorption by the strands of water and of water soluble glue from the mixture. Water absorbed by strands 10 to 15 tends to facilitate curing of the joint compound mixture. Absorption of glue by strands 10–15 significantly enhances the adhering of the joint compound mixture to strands 10–15 and also, while enabling strands 10–15 15 to retain their pliable, stretchable nature, helps avoid excessive stretching of strands 10–15. The water soluble glue utilized in preparing the joint compound mixture can be Borden's glue, another water soluble white glue, or any other water soluble glue. Presently, the joint compound mixture is prepared utilizing about two cups of glue, two cups of joint compound, and an amount of water sufficient to produce the desired spreadable consistency. The volume ratio of glue to joint compound can vary from 0.5:1.0 to 3.0:1.0.

The joint compound mixture can also include a cellulose paste, like metylan cellulose, to retain water to slow the curing of the mixture. The cellulose paste also reduces the brittleness of the dried joint compound mixture. Sawdust can be added to give a pitted, stone-like effect. As used herein the term "sawdust" refers to wood, paper, or other particles which produce a pitted effect and which will also absorb at least certain color pigments which are water soluble, oil soluble, and/or capable of being carried in suspension in a water or oil base paint or coloring solution. QUICK FIX or comparable commercially available products can also be included in the joint compound mixture to increase the strength of the mixture. The volume ratio of cellulose paste to joint compound can vary from 0.5:1.0 to 2.0:1.0. The volume ratio of sawdust to joint compound can vary from 0.2:1.0 to 6.0:1.0. The volume ratio of QUICK FIX to joint compound can vary from 0.2:1.0 to 4.0:1.0.

After the first layer 16 of joint compound mix 16 is applied portions of strands 10–15 are normally still visible. Before layer 16 hardens, a second layer 17 of joint compound mixture is applied to cover layer 16 and to cover any exposed strands 10–15. The layers 16, 17 and strands 10–15 are then permitted to dry. Layer 16 adheres to layer 17.

Figure 4:
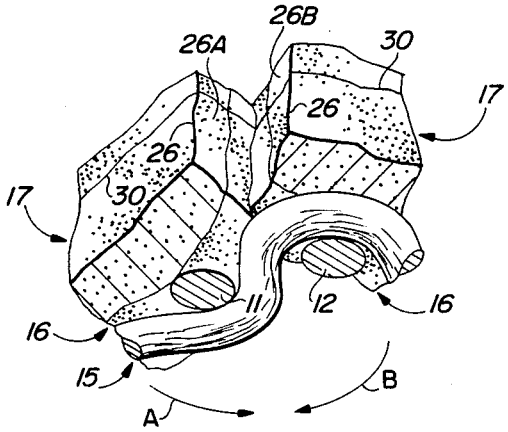

After layers 16, 17 are dry, they are stressed to form cracks 25 to 30. Cracks 25 to 30 extend through layers 16 and 17 to the strands comprising sheet 18. Cracks 25 to 30 can be formed by placing wallcovering including layers 16, 17 and sheet 8 on a piece of foam rubber and by dropping or pressing a two by four against the wallcovering to stress and crack the wallcovering. Any other method of stressing the wallcovering to produce cracks 25 to 30 can be utilized. The intervals between the cracks can be varied as desired, however, it is important that the cracks extend completely through layers 16, 17 to sheet 8, because such cracks make the wallcovering pliable and, in combination with the bonding of layer 16 to strands 10–15, make the wallcovering surprisingly durable. The pliable nature of the wallcovering is demonstrated in FIGS. 1 and 4. When the wallcovering is dry and has been cracked, it can, for example, be bent downwardly in the direction of arrows A and B in FIG. 1 to open crack 26. As would be appreciated by those of skill in the art, bending the wallcovering downwardly in the directions indicated by arrows A and B also tends to open cracks 25, 27 and 28. FIG. 4 illustrates crack 26 after the wallcovering of FIG. 1 is bent or displaced in the directions of arrows A and B and after the side walls 26A, 26B have pivoted about sheet 8 in the directions indicated by arrows C and D. As shown in FIG. 4, the side walls 26A, 26B of crack 16 act as hinged members which are turned or folded downwardly about a generally linear portion of strands comprising sheet 8. Although not necessary, it is preferred that at least two sets of parallel cracks be formed through layers 16 and 17. The first set of cracks 25–28 are generally parallel and spaced apart. The second set of cracks 29, 30 are also generally parallel but are at an angle to and intersect the first set of cracks 25 to 28. Producing sets of cracks which intersect one another gives the wallcovering pliability about more than one axis. For example, cracks 25 to 28 give the wallcovering pliability to be folded about axis Z in FIG. 1. Cracks 29 and 30 give the wallcovering pliability to be folded about axis X in FIG. 1.

After the wallcovering is stressed to form cracks 25–30, a liquid oil base coloring agent coating is applied to layer 17. This coating has a sufficiently low viscosity to be absorbed into cracks 25–30 and into the opposing wall pair comprising each crack. For example, if the coating were applied to layer 17 in FIG. 1, the coating would penetrate crack 26 and penetrate opposing walls 26A and 26B comprising crack 26. While the coating need not penetrate the entire surface area of opposing walls 26A and 26B, it is preferred that all, or nearly all, of the surface areas of walls 26A, 26B be penetrated because the coating seals the walls and makes them water resistant. If the walls 26A, 26B are not made water resistant and, for instance, a water base coloring coating is applied, the water base coating softens walls 26A, 26B and tends to make them adhere to one another. This reduces the pliability of and weakens the wallcovering. After a water base coloring coating has, without sealing cracks 25– 30 with an oil base or other water resistant sealant, been applied, the wallcovering of FIG. 1 will tend to again crack along cracks 26–30 and to produce dust and particles which fall free from the wall covering. Similarly, if cracks 25–30 are not sealed with an oil base liquid, high humidity can soften walls 26A, 26B and cause them to crumble. The oil base sealing function and the penetrating function of the coloring agent coating are therefore crucial in the wallcovering of the invention. The liquid oil base coloring agent coating can be applied in two steps. In one step the oil base penetrating liquid is applied to seal the cracks. In the other step a liquid carrying a color agent is applied. An oil base woodstain or other oil base paints for wood can be utilized as the oil base coloring agent coating.

Once a sealing liquid has been applied to layer 17, one or more additional coats of coloring agents or pigments can be applied, including water base color coatings. Such additional coats are typically utilized to highlight high points, low points, and other surface contour features of the wallcovering.

The completed wallcovering of the invention utilizes physical characteristics of woven sheets or backings which were looked on as undesirable in the past. The permeability of the woven sheets is important in the invention because the joint compound mixture must penetrate through interstitial openings in the woven backing and because it is important that water and glue be absorbed by the woven material. Further the woven backings have a pliability and a stretchability which protect and significantly increase the durability of the wallcovering of the invention. The pliability of the wallcovering is illustrated in FIG. 4 and was earlier discussed. While the glue in the joint compound mixture utilized in the wallcovering is absorbed by and helps minimize stretching of the woven sheet 8, the sheet can still, to a limited extent, stretch. Such stretching tends to occur at the points of strands 10–15 immediately adjacent cracks 25–30, which further illustrates the importance of the cracks. Consequently, when the sheet 8 is stressed, it will stretch in directions perpendicular to walls 26A, 26B and permit the lateral distance between the walls to increase. The strands 10–15 also have a limited amount of memory. After sheet 8 has been tensioned and stretched, and the tension released, sheet 8 tends to return to its original dimensions. As a result, one of the great virtues of the invention is that it can be nailed, glued or otherwise attached to an existing wall at selected spaced apart points. If the wall expands or contracts with changes in temperature, humidity, etc., the stretchable nature of sheet 8 permits sheet 8 to also undergo such minor stretching.

Sheet 8 of the wallcovering can be glued at all points to a wall in a home or other building structure. It is preferred that sheet 8 be glued, nailed, or otherwise attached only at selected points on the wall and be permitted otherwise to hang free on the wall. This simplifies installation and removal of the wallcovering and also more readily enables the wallcovering to adapt to minor expansion and contraction of the wall.

The application of the joint compound mixture in two separate, but bonded, layers 16 and 17 is important in the practice of the invention. It might appear that layers 16 and 17 can be applied in a single step. When, however, a thicker layer of joint compound mixture is pressed onto sheet 8, the downward force of the putty knife or other tool means utilized to press the mixture against sheet 8 tends to be outwardly dissipated through the layer of joint compound intermediate the putty knife and sheet 8. Accordingly, it is much preferred to applied a thinner first layer 16 which is effectively forced through interstices 9 and leaves portions of strands 10–15 visible. Once joint compound mixture is forced entirely through interstices 9, then second layer 17 of the joint compound mixture can be applied.

Figure 2:
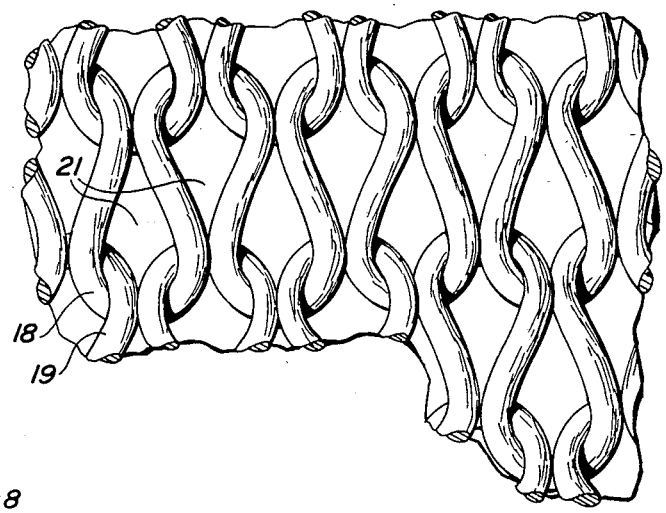
FIG. 2 is a top view illustrating an alternate fabric weave which can be utilized in fabricating the wallcovering of the invention.

FIG. 2 illustrates another of the many weave patterns which can be utilized in the practice of the invention. The weave includes strands 18, 19 forming interstitial openings 21 therebetween.

When joint compound and water soluble glue are mixed to form the joint compound mixture, additional water need not be added to the mixture. If the water soluble glue is thick, or if sawdust or other water absorbent materials are included in the joint compound mixture, then additional water is usually added to the mixture.

I have also discovered that Thomson's water sealer can be applied to dried wallcoverings produced in accordance with the invention. This water sealer waterproofs the wallcovering and permits it to be used as flooring.

The second set of cracks 29, 30 can be at a diagonal to or at any other desired angle to the first set of cracks 25 to 28.

As would be appreciated by those of skill in the art, Ross Adhesives of Detroit, Mich. produces metylan cellulose paste. Custom Building Products of Houston, Tex., along with a variety of other manufacturers, produces joint compound powder. Custom Building products of Houston, Tex. also distributes QUICK FIX.

Having described my invention in such terms as to enable those skilled in the art to understand and practice it, and having identified the presently preferred embodiments thereof, I claim:

1. A method for making a pliable wallcovering which replicates the appearance of aged, cracked plaster wall finishes, which can be readily hung over an existing wall, and which is durable and wear resistant, said method comprising the steps of (a) weaving water absorbent strands of material in a coarse weave to form a pliable stretchable fabric sheet with interstitial openings extending between the strands from the top to the bottom of said sheet, said strands being comprised of a plurality of threads;

(b) mixing joint compound, water, and water soluble glue to form a spreadable joint compound mixture;

(c) spreading a first layer of said joint compound mixture over the top of said woven sheet to force said joint compound mixture into and through at least certain of said interstitial openings to the back of said sheet, said strands absorbing water and water soluble glue from said joint compound mixture;

(d) spreading a second layer of said joint compound mixture over said first layer to cover said top of said woven sheet;

(e) drying said first and second layers of joint compound and said strands of material;

(f) stressing said dried layers of joint compound to form a plurality of cracks each extending through said layers to said pliable woven sheet, each of said cracks acting as hinge members which can be folded about said sheet;

(g) applying a liquid oil base coloring agent coating to said cracked dried second layer to penetrate and seal the surfaces of each of said cracks to inhibit the sealing together of said crack surfaces when water is applied to said wall covering.

2. The method of claim 1 wherein said cracks include first and second sets of substantially parallel spaced apart cracks, said first set of cracks being at an angle with respect to and intersecting said second set of cracks.

3. The method of claim 1 including the additional step of applying a second coating of a coloring agent to said dried second layer to highlight the surface contour of said second layer.

4. A method for making a wallcovering which replicates the appearance of plaster wall finishes, which can be readily hung over an existing wall, and which is durable and wear resistant, said method comprising the steps of (a) weaving water absorbent strands of material in a coarse weave to form a pliable stretchable fabric sheet with interstitial openings extending between the strands from the top to the bottom of said sheet, said strands being comprised of a plurality of threads of said material;

(b) mixing joint compound, water, water soluble glue, cellulose paste, and sawdust to form a spreadable joint compound mixture;

(c) spreading a first layer of said joint compound mixture over the top of said woven sheet to force said joint compound into and through at least certain of said interstitial openings to the back of said sheet, said strands absorbing water and water soluble glue from said joint compound mixture;

(d) spreading a second layer of said joint compound mixture over said first layer to cover said top of said woven sheet;

(e) drying said first and second layers of joint compound and said strands of material;

(f) cracking said layers of joint compound;

(g) applying a liquid oil base coloring agent coating to said dried second layer to penetrate and seal the surface of said second layer and the surfaces of the cracks to inhibit the absorption of water applied to said second layer.

5. The method of claim 4 including the step of stressing said dried layers of joint compound mixture to form at least one crack extending through said layers to said pliable woven sheet, said crack acting as a hinge about which said covering can pliably folded.

6. The method of claim 1 including the step of attaching said sheet to a wall in a building structure.

7. The method of claim 6 wherein said sheet is attached to said wall at selected spaced apart points on said wall such that when said wall expands said fabric sheet stretches intermediate said attachment points.

8. The method of claim 4 including the step of attaching said sheet to a wall in a building structure.

9. The method of claim 8 wherein said sheet is attached to said wall at selected spaced apart points on said wall such that when said wall expands said fabric sheet stretches intermediate said attachment points.

10. The method of claim 1 wherein said threads are comprised of a material selected from the class consisting of hemp and jute.

11. The method of claim 2 wherein said threads are comprised of a material selected from the class consisting of hemp and jute.

12. The method of claim 4 wherein said threads are comprised of a material selected from the class consisting of hemp and jute.

13. The method of claim 5 wherein said threads are comprised of a material selected form the class consisting of hemp and jute.

* * * * *